US005666707A

United States Patent [19]

Cryderman et al.

[11] Patent Number: 5,666,707

[45] Date of Patent: *Sep. 16, 1997

[54] CONVENTIONAL OR CONTINUOUS ROLLING PROCESS

[75] Inventors: Robert L. Cryderman; John C. Winkley, both of Pueblo, Colo.

[73] Assignee: CF&I Steel, L.P., Portland, Oreg.

[*] Notice: The term of this patent shall not extend beyond the expiration date of Pat. No. 5,507,081.

[21] Appl. No.: 497,556

[22] Filed: Jun. 30, 1995

Related U.S. Application Data

[60] Division of Ser. No. 80,431, Jun. 18, 1993, Pat. No. 5,472,041, which is a continuation-in-part of Ser. No. 568,491, Oct. 15, 1990, Pat. No. 5,419,387, which is a division of Ser. No. 444,789, Dec. 1, 1989, Pat. No. 5,018,666.

[51] Int. Cl.[6] ..... B22D 11/06

[52] U.S. Cl. ..... 29/33 C

[58] Field of Search ..... 29/33 C, 527.7; 164/476, 460, 477, 433; 72/225, 226

[56] References Cited

U.S. PATENT DOCUMENTS 5,507,081 4/1996 Cryderman et al. ..... 29/33 C

*Primary Examiner*—William R. Briggs

*Attorney, Agent, or Firm*—Davis, Graham & Stubbs LLP

[57] ABSTRACT

A railroad rail produced by rolling a substantially round bloom, together with a process and system for manufacturing the same. The round bloom may be produced by continuous casting methods. The bloom is initially rolled into a substantially rectangular shape and then into a rail. The rolling process may be continuous and in-line to allow for the production of very long seamless rails.

14 Claims, 3 Drawing Sheets

CONVENTIONAL OR CONTINUOUS ROLLING PROCESS

This is a divisional of application Ser. No. 08/080,431 filed on Jun. 18, 1993, U.S. Pat. No. 5,472,041 which is a continuation-in-part of application Ser. No. 07/568,491 filed Oct. 15, 1990, U.S. Pat. No. 5,419,387, which is a divisional application of application Ser. No. 444,789 filed Dec. 1, 1989 and now issued as U.S. Pat. No. 5,018,666.

FIELD OF THE INVENTION

The present inventions relates to the field of railroad rails and, in particular, to a railroad rail produced from a round bloom. Optionally, the rail may be manufactured from the round bloom using a continuous rolling technique in which the steel shape is rolled from bloom to final rail in a continuous in-line manner to produce a very long rail without the necessity for any conventional reverse rolling.

BACKGROUND OF THE INVENTION

Railroads maintain a vital position in the transportation of goods and, to a lesser extent, passengers. The maintenance of the current rail system and the establishment of new rail line requires a continuous source of new railroad rails.

Traditionally, rails have been manufactured in lengths of about 39 feet by reverse rolling rectangular blooms. While it is known that blooms can be produced for a variety of steel shapes in virtually any desired cross-section, the cross-section of blooms from which rails are rolled has traditionally been rectangular. This is principally due to the fact that a finished rail has a cross-section which loosely approximates a rectangle, in that it has a flat base, a roughly vertical web and a more or less flat head, although of course the web is much thinner than the base or head. Therefore, the rail can be produced from a rectangular bloom with less rolling than from, for example, a circular bloom. From the standpoint of rolling efficiency alone, without considering other factors, it is generally thought that it is better to start with a rectangular bloom than with a square bloom. In addition, rectangular blooms are easier to stack and handle than circular blooms.

These advantages of a rectangular bloom over a circular bloom in the production of rails is believed to be offset by other factors. One set of factors relates to the casting process and another set of factors relates to the quality of the finished rail. A continuous caster of the type used to produce large blooms for rolling large shapes such as rails is easier and less expensive to manufacture and maintain if the blooms are round rather than rectangular. Moreover, the number of continuous caster strands may be reduced because a round bloom can be produced at a higher rate than a rectangular bloom and the strand design can be simpler. See, e.g., Ing, Pleschiutschnigg, Rensch, Obering, Schrewe, Continuously Cast Rounds in Combination with the High Reduction Technology to Produce Rods, Bars and Sections up to Medium Size Range, Fachberichte Hüttenpraxis Metalweiterverarbeitung, Vol. 25, No. 4 1987.

Regarding the quality of the finished rail, a round bloom cools much more uniformly than a rectangular bloom since the round bloom has no undercooled edges. This results in an improved product that is metallurgically more uniform with a better surface quality.

The 39 foot length of traditional rails was due to the length of the railroad cars that carried the rails to the installation site. At the installation site, the 39 foot sections were bolted together to form a continuous rail. The resulting continuous rail had joints every 39 feet which produced a bumpy ride and were susceptible to wear. Later methods utilized somewhat longer rail lengths such as 100 feet in order to lessen the number of joints in the installed rail, or attached the individual rail lengths to one another by welding rather than by bolting to produce a smoother and better wearing joint. Even then, however, there was a noticeable joint that produced a bumpy ride and was susceptible to wear. Still later methods performed the majority of the welds at the rail manufacturing facility to produce very long sections comprising a number of welded together smaller sections. The long sections were then transported to the installation site and joined there. The result was a rail having high-grade closely-spaced welds made at the manufacturing facility together with lower-grade longer-spaced welds made at the installation site. While this rail is an improvement over previous methods, even the high-grade welds made at the manufacturing facility resulted in a noticeable joint that produced a bumpy ride and lead to wear. A vast improvement over these prior art methods was finally described in U.S. Pat. Nos. 5,018,666 and 5,195,573, assigned to the assignee of the present invention. Those patents describe a very long rail, such as 200 to 500 feet to a quarter mile, that is produced seamlessly by a continuous rolling process. When installed, that rail includes long-spaced welds made at the installation site as in the case of conventional rails, but does not include any closely-spaced welds or other joints. The installed rail is thus less expensive to manufacture, results in a smoother ride, and is better wearing. The long rail and rolling process of the above-referenced patents may be used in the process of rolling rails from circular blooms as described in the present patent.

SUMMARY OF THE INVENTION

The present invention is a railroad rail produced by rolling a substantially round bloom and a method and system for manufacturing such a rail. The round bloom is initially squared off to an approximately rectangular cross-section, and is then rolled in the manner of other rectangular cross-sections to produce a finished rail. Although this process entails more rolling than in conventional processes that begin with a rectangular bloom, the resulting finished rail has superior internal metallurgical properties and surface quality. In addition, the production of the round bloom is simpler, less expensive, faster, and requires less capital investment than the production of a rectangular bloom.

The circular bloom can be rolled into a rectangular bloom and ultimately into a finished rail by reverse rolling or by using continuous rolling techniques that do not entail reverse rolling. If the rolling is accomplished by continuous rolling techniques not entailing reverse rolling, a very large bloom may be used for the production of a very long seamless rail. In addition to the superior metallurgical properties resulting from beginning with a round bloom, such very long seamless rails have the notable advantage of very few joints in the installed track.

The round bloom can be produced using conventional bloom casting methods or, preferably, using continuous casting methods. Because a round bloom can be continuously cast faster than a rectangular bloom, fewer continuous casting strands may be required in a multiple strand set-up.

DETAILED DESCRIPTION OF THE INVENTION

Figure 1:
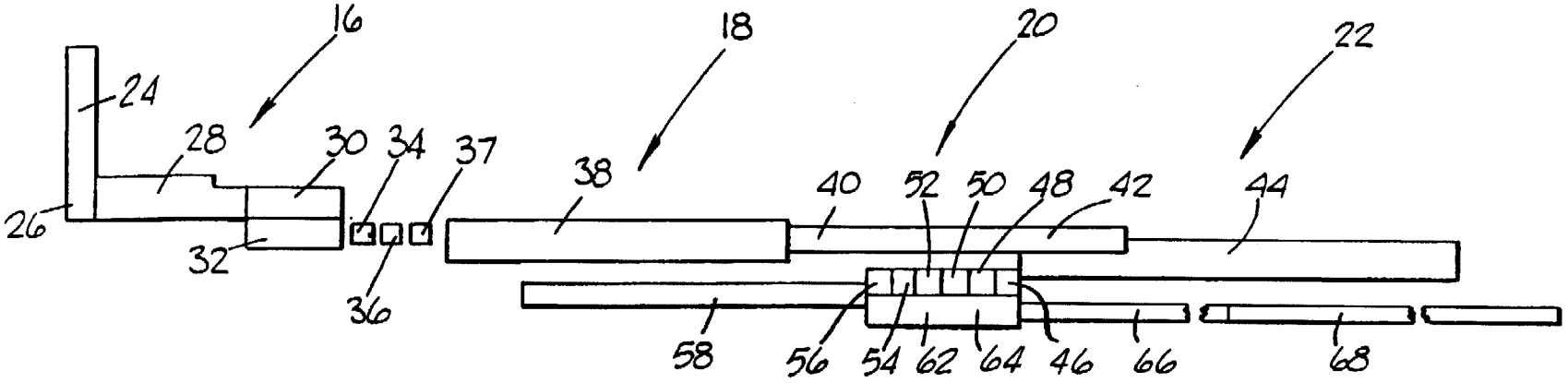
FIG. 1 is a diagrammatic representation of a manufacturing facility in accordance with the present invention.

As shown in FIG. 1, a manufacturing facility in accordance with the present invention preferably includes a continuous casting area 16, a rolling section 18, a controlled cooling section 20 and a final cooling section 22. The discussion below first describes the production of a round bloom in the continuous casting area 16 and the deformation of the round bloom into a finished rail by rolling in the rolling section 18.

The continuous casting area 16 includes one or more strands of continuous casters to produce substantially round (as defined below) blooms. As previously mentioned, round blooms can be continuously cast at a higher rate than rectangular blooms. Therefore, for a given rail production rate, fewer strands of continuous casters may be required for the production of the necessary quantity of round blooms than for the production of the same necessary quantity of rectangular blooms.

In a continuous casting process, the molten steel is poured through a mold that has the desired cross-sectional shape and the molten steel flows through the mold until it is cooled and attains a generally solid form. At this point the steel exits the casting mold. Continuous casting is in contrast to fixed mold casting, wherein a mold is filled with molten steel, allowed to solidify, and the mold removed, leaving an ingot to be reheated and cooled. The upper portion of the mold of the continuous caster is held in a vertical position with the molten steel being poured into the top. The steel is allowed to flow through the mold at such a speed that the steel is relatively firm when exiting the bottom of the mold and is directed in a horizontal direction. The continuous movement of the bloom may be continued directly into the rolling section 18. Alternatively, the bloom may be allowed to cool and then reheated prior to entering the continuous rolling section 18.

Figure 2:
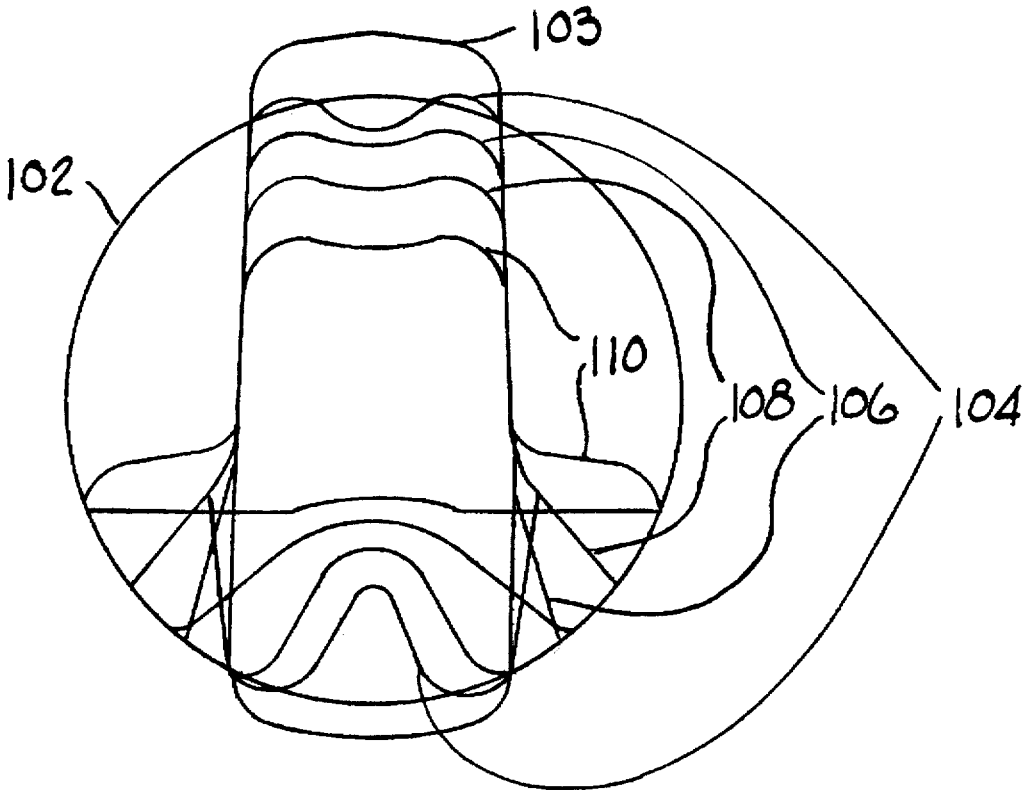
FIG. 2 is a diagrammatic representation of the cross-section of a circular bloom, with multiple outlines of the cross-section as it is gradually rolled toward the shape of a rail by a plurality of rolling passes.
Figure 2A:
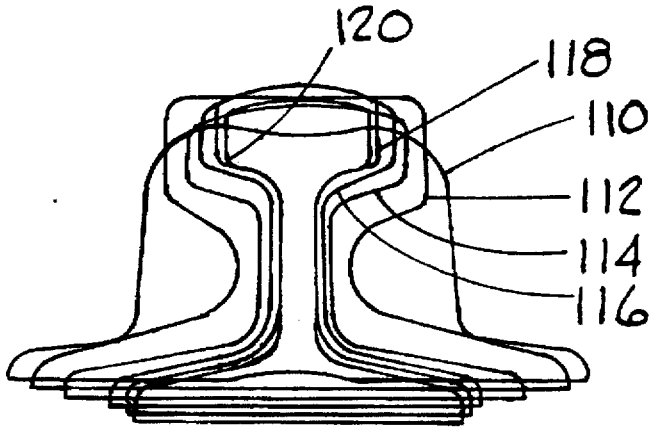
FIG. 2A is a diagrammatic representation continuing from FIG. 2.
Figure 4:
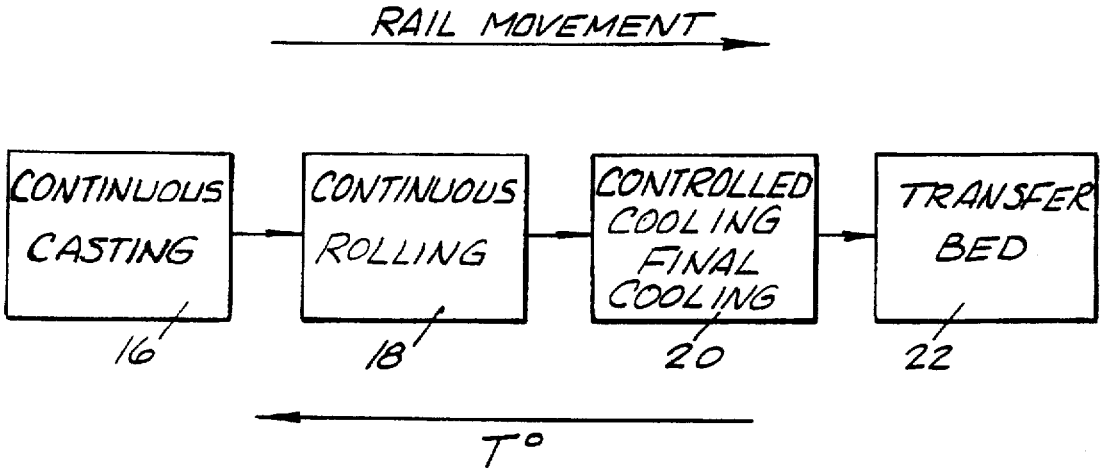
FIG. 4 is a diagram showing a decrease in temperature in the direction of travel of the rail.

FIGS. 2 and 2A show the gradual deformation of a round bloom into a rail by repeated rail passes in the rolling section 18. Referring first to FIG. 2, the bloom 102 is seen to be substantially circular in cross-section. It will be appreciated, however, that the bloom 102 can be other than perfectly circular in cross-section without departing from the spirit of the invention. For example, the bloom 102 may be oval, elliptical or egg-shaped in cross-section, and still result in a rail having the desirable internal metallurgical properties and surface characteristics of a rail produced from a circular bloom in accordance with the preferred embodiment. For purposes of defining the invention, the invention should be deemed to include the use of blooms having relatively blunt corners; that is, corners of more than about 2 inches radius.

The bloom 102 is initially deformed to a roughly rectangular shape 103 by a series of roller passes in a high reduction machine or other roller. The roughly rectangular shape is further deformed by indenting the base and rolling the base flanges out from the body as shown in the outlines 103, 104, 106, 108 and 110.

The shape 110 resulting from the rolling operations of FIG. 2 is further deformed into a finished rail by additional rolling passes which produce the shapes 112, 114, 116, 118 and 120 shown in FIG. 2A. Of course, a particular rolling sequence may include greater or fewer steps than those depicted in FIGS. 2 and 2A and may involve a different reduction pattern altogether; the point, however, is that the substantially round bloom 102 is ultimately reduced to a finished rail 120 by reduction rolling of one pattern or another.

The size of the initial round bloom 102 is dependent on the extent of reduction, and hence elongation, that is desired in the rolling process. In the case of rectangular blooms, it is common to use bloom sizes of 250 by 320 mm to produce nine-fold elongation to the finished rail. The same elongation can be produced with a round bloom of about 320 mm in diameter. Other bloom shapes should be about the same weight per length as a 320 mm diameter round bloom to produce nine-fold elongation.

In the embodiment of the continuous rolling section 18 shown in FIG. 1, the malleable steel bloom is continuously and simultaneously processed and formed as it proceeds through a series of rolling stations. The rolling stations are aligned in a straight line in a fixed position. As the lead end of the bloom moves from station to station, each successive rolling station will act to form and to reduce the cross-section of the incipient rail. The embodiment shown in FIG. 1 and described immediately below may be used for the production of very long rails (such as about 500 to about 1,440 feet or longer) by continuous rolling, but it will be appreciated that, alternatively, rails of more conventional lengths could also be produced using either continuous rolling or reverse rolling techniques.

It should be remembered that as the bloom is formed and shaped, the length of the bloom increases nine-fold. Therefore, the velocity of the metal as it exits the continuous rolling section 18 is significantly faster than the velocity of the metal entering the continuously rolling section - even when a single rail is at both the exit and entrance.

As the metal exits the continuous rolling section 18, the rail—which is still moving in a straight line in the same direction—enters the controlled cooling section 20 of the process. In the controlled cooling section 20, cooling means (utilizing water, mist or air) are applied to the rail in an asymmetric manner. As the rail exits the continuous rolling section 18, it may be about 1400° F. to 1800° F. The rail exiting the controlled cooling section 20 will be less than about 800° F. Much of the shrinkage of the rail that will occur as the rail cools, will occur in the controlled cooling section 20. The primary function of the controlled cooling section 20 is for the prevention of rail warping and bowing, in addition to achieving desirable metallurgical properties. The ability to prevent bowing is extremely critical when dealing with rails that are very long. Due to the continuous nature of the process of the present invention, during much of the rail formation process different portions of a given rail may be subjected to both rolling and controlled cooling simultaneously.

Figure 3:
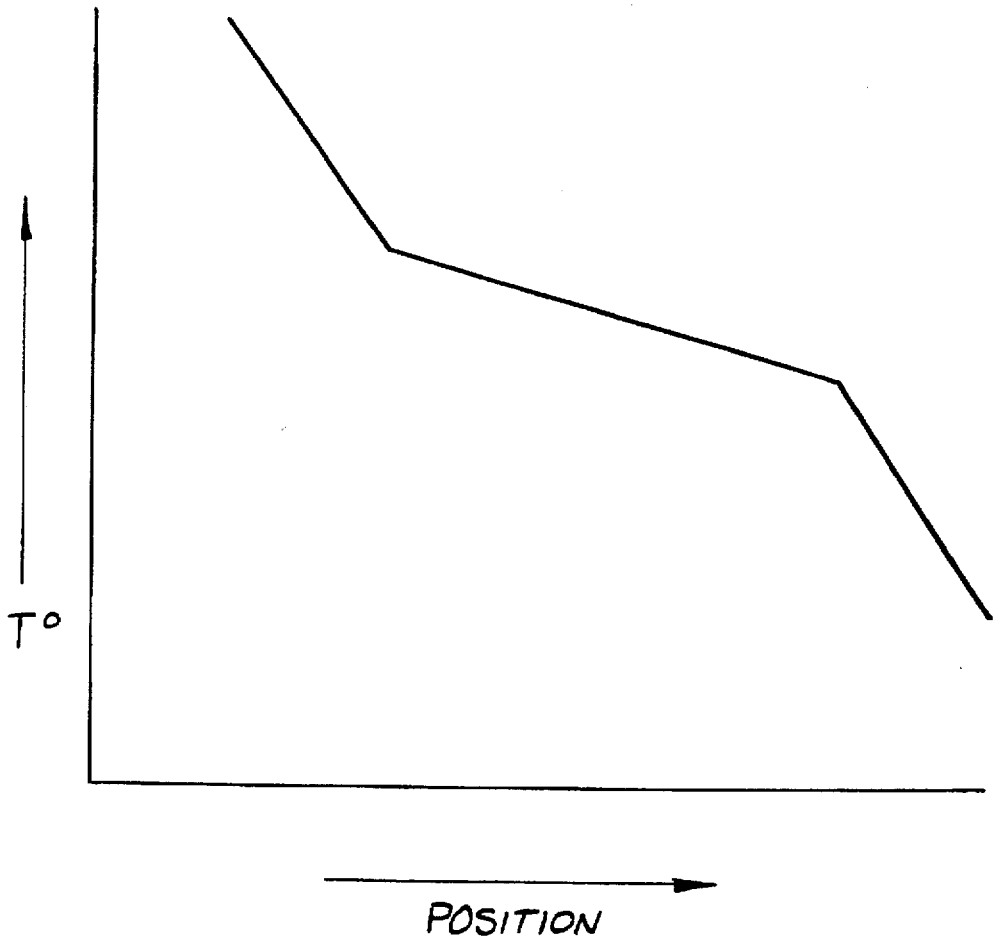
FIG. 3 shows the temperature of a rail as it passes through several portions of the invention.

The continuously moving rail exits the controlled cooling section 20 and proceeds to the final cooling section 22. In the final cooling section, the rail is cooled to normal handling temperatures. FIG. 3 shows in a schematic manner the temperature gradient along the length of a rail which is in the controlled and final cooling sections. Because the rail moves at a uniform rate in the controlled and final cooling section, this graph of temperature versus position on the rail would also correspond to temperature versus time with respect to a single moving point on the rail. As the trailing end of the rail exits the final rolling section and enters the controlled cooling section, the temperature is substantially equal to the desired rolling temperature for the final rolling station. That is shown as the left edge of the graph of FIG. 3. The rail can be cooled rapidly from that temperature, because the cooling rate at that temperature does not substantially affect the metallurgical properties of the rail. However, even at that temperature, the rail may tend to bow or otherwise deform due to the asymmetrical cross-section and differential cooling rates, so some controlled cooling by differential application of cooling means may be required.

Moving along the length of the rail, a point is reached where the cooling rate becomes important to the desired metallurgical properties of the rail. That point is shown as the relatively gently inclined cooling line in the middle of FIG. 3. During that portion, the rail is cooled in a manner which achieves two distinct functions. One is to achieve the desired metallurgical properties, and the other is to differentially apply cooling means to the asymmetrical cross-section to avoid bowing or other deformation.

Finally, continuing to move along the length of the rail toward the leading end, a point is reached where the rail temperature is such that the cooling rate is again not important to the desired metallurgical properties. This is the final cooling section, and is represented by the steep cooling rate on the right side of FIG. 3. As in the case of the steep cooling rate as the rail exits the last roller station and enters the controlled cooling section, however, the rail may still require some differential application of cooling means to avoid undue bowing or other deformation.

The use of a continuous rolling allows a reduction in the rail velocity past the rolling stations, and this reduction is important to the controlled cooling process. In a reverse rolling process, the rail is generally passed through the same rolling station several times as that rolling station progressively reduces the rail cross-section. Therefore, a high rail velocity is necessary on each pass in order to maintain a given production rate. In contrast, in a continuous rolling process, the multiple passes of the reverse rolling process are replaced with multiple in-line rolling stations. This allows a dramatic reduction in rail velocity for the same production rate. The reduced rail velocity of continuous rolling is compatible with continuous in-line controlled cooling, while the high velocity of reverse rolling is not. These reduced velocities also facilitate control of the rail and improve safety.

Once the entire rail has proceeded through both the continuous rolling section 18 and the controlled and final cooling section 20, the forward movement of the continuous process is halted with respect to that rail. The completed rail is then moved laterally in the transfer bed station 22.

Presented next is a more detailed depiction of a preferred embodiment of the manufacturing system and method of the present invention, referring again to FIG. 1. Each of the specific areas of the facility will be described in the order that the incipient rail travels along its way to becoming a completed rail ready to be transported to an installation site.

The continuous casting section 16 is comprised of a hot metal transfer area 24, a degasser and reheat area 26, a caster apparatus 28, a bloom transfer bed 30, and a bloom holding furnace 32. The production of the rail must begin with hot molten steel. The steel may come from raw materials or the melting of scrap metal. In a preferred embodiment, the molten steel is created via the reheating of selected scrap metal in electric arc furnaces, wherein the chemistry, deoxidation, temperature and desulfurization of the molten steel may be carefully controlled. The molten steel is transferred to the top of the caster 28 from the source of molten steel. The molten steel is transferred to the caster in the hot metal transfer area 24.

Prior to introduction into the caster 28, the molten steel is reheated and degassed at area 26. The characteristics of the molten steel are evaluated and any alterations in the chemical composition or temperature necessary prior to casting are made in the reheat and degassing area 26.

The continuous caster 28 consists of one or more continuous casting strands. The molds are vertical in the uppermost portions where the molten steel is the most fluid. The molds may curve toward horizontal in order to facilitate the flow of steel out of the mold in a horizontal direction.

The bloom transfer bed 30 is an area for storing and transferring the blooms produced in the caster apparatus 28. The transfer bed 30 is capable of moving the malleable bloom perpendicular to its length. The bloom holding furnace 32 is adjacent the bloom transfer bed 30 and serves two functions. The holding furnace helps assure that the bloom is maintained at a consistent and desirable temperature for rolling, and it is equipped with means for transferring the bloom to the entrance of the continuous rolling section 18.

The continuous rolling section 18 is comprised of a crop/shear area 34, an induction heat area 36, a descaler 37 and a rolling mill 38. In the crop/shear area 34, means are provided for preparing the leading edge of the bloom for introduction into the rolling mill. In the induction heat area 36, means are provided for assuring the proper temperature consistency within the bloom as it passes through the area.

The rolling mill 38 is made up of a plurality of rolling stations in line with each other. The rolling stations consist of a motor and large spinning rollers that are designed to exert deforming pressure on the steel passing between the rollers. The rollers also act to move the steel through the rolling mill 38.

The controlled cooling section 20 of the present invention contains a controlled cooling area 40 and final cooling area 42. The controlled cooling section 20 has means for asymmetrically treating the formed rail in order to prevent significant bowing of the rail during the cooling of the rail from its final rolling temperature. The controlled cooling may be performed by the application of a mist or gas stream to selected areas of the rail. The cooling is controlled both to prevent deformation and to achieve desired metallurgical properties.

In the final cooling area 42 a more symmetric cooling of the rail is employed, but differential cooling is still required to achieve acceptable rail straightness. In the rail transfer bed 44, the forward motion of the rail is halted and the rail may be moved laterally.

The areas just described are necessary to continuously form a very long unitary rail according to the method of the present invention. However, completion of the rail treatment process involves a number of additional functional steps. In a preferred embodiment of the present invention, the additional areas of the post-formation section include: rail straightener area 46, post-rolling descaler area 48, position sensor 50, UT inspection 52, surface inspection 43, paint marking 56, transfer bed 58, saw and drill 62, welder 64, storage rack 66, and train loading rack 68.

The rail straightener area 46 contains means capable of correcting slight bowing imperfections in the rail product. In one embodiment, the rail straightener consists of massive rollers that will exert from 100 to 80 tons of straightening force on the rail. The exterior surface of rails are descaled in the descaler area 48. The position sensor 50 acts to verify acceptable rail straightness. The rail is ultrasonically inspected at the UT inspection area 52 for internal defects. Ultrasonic inspection will detect internal flaws in the head, web and base portions of the rail. Surface inspection of the rail occurs at the surface inspection area 54. Where required, paint marks are applied to any defective portions of the rail at the paint area 56.

Transfer bed 58 provides means for laterally moving the rail. Saw and drill area 62 has means for sawing rail ends and the rails on either side of any imperfection noted in the inspection processes and for drilling bolt holes if required. It also prepares the two pieces for welding. The welding area 64 has equipment for welding the rail where sections have been cut out in the saw and drill area 62. The storage rack 66 is capable of storing several of the finished rails and the train loading rack 68 provides means for loading the finished rail onto a railroad car for removal of the rail from the manufacturing site.

In the post-formation processing of the rail, the rail is first moved laterally in the rail transfer bed 44. After transfer, the rail is moved axially in the direction opposite the movement of the rail in the formation process. The leading edge of the rail passes the rail straightener area 46, the descaler area 48, the position sensor 50, the UT inspection area 52, the surface inspection area 54, and the point area 56. Upon exiting the point area 56, the leading edge of the rail proceeds onto the transfer bed 58 until the entire rail has passed through the paint area 56 and at which time the axial movement of the rail is stopped. The rail is moved laterally in the transfer bed and the leading end is sawed off at the saw and drill area 62.

At this time, axial movement of the rail is begun, now in the same direction as the rail during the rail formation process. If any areas of rail imperfections were identified during the inspection processes, as the rail passes through the saw and drill area 62, the forward movement will be halted and the rail will be sawed on either side of the imperfection. The two ends will then be welded together at the weld area 64. The rail motion will then continue until the trailing end of the rail reaches the saw and drill area 62. The trailing end will be sawed off and the rail motion will then continue until the entire rail is placed on the storage rack 66.

What is claimed is:

1. A system for producing a railroad rail, comprising a round bloom caster to produce a bloom having a cross-section with any corners at least 2 inches radius; a set of rollers for rolling the round bloom into a rail; and means for transporting the bloom from the caster to the rollers.

2. The system of claim 1, wherein the round bloom caster is a continuous caster.

3. The system of claim 2, wherein said continuous caster includes a plurality of casting strands.

4. The system of claim 1 wherein said set of rollers includes an initial set of squaring rollers to shape the bloom into a substantially rectangular cross-section, and a subsequent set of rollers to shape the substantially rectangular cross-section into a rail.

5. The system of claim 1, wherein said set of rollers are in-line.

6. The system of claim 5, wherein said set of rollers are sufficiently spaced to produce a rail at least 200 feet long.

7. The system of claim 6, wherein said set of rollers are sufficiently spaced to produce a rail about 1,440 feet long.

8. The system of claim 1, further comprising a controlled cooling section for cooling the rail after rolling.

9. The system of claim 8, wherein the controlled cooling section has cooling means utilizing at least one of water, mist or air.

10. The system of claim 9, wherein the controlled cooling section is engaged with the rollers so that the rail may have simultaneously a portion being rolled and a portion being cooled.

11. The system of claim 10, further comprising:

a final cooling section wherein the rail is cooled to normal handling temperatures; and means for transporting the rail from the controlled section area to the final cooling section.

12. The system of claim 1, wherein said bloom is made from molten steel, and the system further comprises a degaser wherein the molten steel is degassed and a reheater wherein the molten steel is reheated prior to the formation of said boom.

13. The system of claim 12, further comprising a crop/shear area wherein the bloom is prepared for introduction into the set of rollers, an induction heat are for assuring temperature consistency within the bloom, and a descaler for descaling the bloom.

14. The system of claim 1, further comprising:

a rail straightener area having means for correcting bowing imperfections in the rail product;

a descaler for descaling the surface of the rail;

an ultrasound inspector for inspecting the rail for internal defects;

a surface inspection area for surface inspection of the rail; and a transfer area for laterally moving the rail.

* * * * *